United States Patent [19]

Wilson et al.

[11] Patent Number: 4,632,468

[45] Date of Patent: Dec. 30, 1986

[54] GUIDE FOR WELL PUMP SUCKER ROD

[75] Inventors: James A. Wilson; Robert L. Heinonen, both of Dallas, Tex.

[73] Assignee: Double-E Inc., Dallas, Tex.

[21] Appl. No.: 732,361

[22] Filed: May 8, 1985

[51] Int. Cl.[4] ..... F16C 29/02

[52] U.S. Cl. ..... 175/325

[58] Field of Search ..... 308/4 A, 4 R, 3 R; 175/325; 166/241

[56] References Cited

U.S. PATENT DOCUMENTS

| | | | |
|---|---|---|---|
| 3,414,337 | 12/1968 | Sable | 308/4 |
| 3,442,558 | 5/1969 | Sable | 308/4 |
| 4,403,668 | 9/1983 | Ramsey | 308/4 A |

*Primary Examiner*—Lenard A. Footland

*Attorney, Agent, or Firm*—H. Mathews Garland

[57] ABSTRACT

A well pump sucker rod guide which is a tubular integral body element formed of an elastic minimum friction type material and provided with a longitudinal bore formed along the longitudinal axis of the body, a transverse mounting slot opening from a side of the body into the bore dividing the body into opposite end portions, and a longitudinal mounting slot in each end portion extending radially inwardly into the bore and opening at one end through an end of the body and at the other end into the transverse slot, one of the longitudinal slots extending in the opposite radial directions from the other longitudinal slot, and each said slot being defined by radially outwardly diverging guide walls which also diverge toward the transverse mounting slot. The guide is mounted on sucker rod sections to centralize the reciprocating rod in a production tubing in which a pump is mounted and operated by the rod.

17 Claims, 6 Drawing Figures

GUIDE FOR WELL PUMP SUCKER ROD

BACKGROUND OF THE INVENTION

1. Field of the Invention

This invention relates to well tools and more particularly relates to guides for sucker rods used to drive a sub-surface well pump in the production tubing of a well for lifting well fluids through the tubing to the surface.

2. History of the Prior Art

Well fluids, particularly oil, in situations where there is no natural formation drive, are often produced by reciprocating pumps positioned in the well at a depth at which the oil and related fluids flow into the well bore. The pump is driven by a sucker rod connected between a pumping jack at the surface end of the well and the pump plunger. The sucker rod is a string of end-to-end connected rod sections extending downwardly in the well production tubing. More often than not the production tubing of a well is not straight but rather deviates in a number of different configurations sufficiently to cause the sucker rod to rub against the tubing wall surface. Such rubbing produces wear along some of the sucker rod sections and the production tubing wall. It has been standard practice for many years to minimize sucker rod and production tubing wall wear as well as to improve the efficiency of operation of a sucker rod by holding the sucker rod centrally disposed in the production tubing with rod guides. The rod guides are fabricated of materials which minimize friction and are configured to permit well fluids to flow past the guides within the production tubing. Such guides are normally slotted to permit installation of the guides on the rod by pressing them laterally from the side of the rod rather than requiring insertion of the rod at one end through the guides. Once the guides are pressed on the sucker rod they preferably grip the rod sufficently tightly to prevent slippage of the rod in the guide as the rod and guides reciprocate. Typical prior art sucker rod guides formed of soft materials such as oil resistent rubber and requiring metal inserts for holding the guides on the sucker rods are shown in the following U.S. Pat. Nos.: 2,655,113; 2,793,917; 2,928,472; 3,001,834; 3,186,773; and 3,650,579. In some of the guides shown in these prior art patents, the insert fits within the bore of the guide and grips the surface of the sucker rod. In other prior art patented rod guides the insert is embedded within the guide material squeezing the guide against the sucker rod surface. Such rod guide designs are shown in U.S. Pat. Nos. 3,001,834 and 3,414,337. The use of such guides requires both additional manufacturing and assembly costs and precedures. A still further prior art sucker rod guide is shown in U.S. Pat. No. 3,442,558 which has upper and lower sections provided with misaligned longitudinal bores each of which communicates with longitudinal, radially extending slots which increases in width from the narrowest portion at the outer surface of the guide to the widest portion where the slot opens into the guide bore.

SUMMARY OF THE INVENTION

It is an object of the present invention to provide a guide for well pump sucker rods.

It is another object of the invention to provide a sucker rod guide which may be made of a single continuous phase elastic material not requiring additional metal inserts.

It is another object of the invention to provide a sucker rod guide which is quickly and easily mounted on a sucker rod.

It is a further object of the invention to provide a sucker rod guide which tightly grips a sucker rod to prevent relative movement between the rod and the guide.

It is another object of the invention to provide a sucker rod guide which may be mounted on a sucker rod by pressing the guide laterally rather than requiring insertion of an end of the rod into the guide.

It is another object of the invention to provide a sucker rod guide which minimizes stresses in the guide material during the installation process.

It is another object of the invention to provide a sucker rod guide which has maximum material strength along the lines of maximum stress during installation.

It is another object of the invention to provide a sucker rod guide which provides more material along areas of maximum wear than provided in prior art guides.

It is another object of the invention to provide a sucker rod guide which has longer wear life than prior art devices.

It is another object of the invention to provide a sucker rod guide which has greater rod gripping force than prior art devices.

It is a further object of the invention to provide a sucker rod guide which has greater well fluid bypass area than prior art devices.

It is a still further object of the invention to provide a sucker rod guide which is easier to install than prior art devices.

In accordance with the invention there is provided a sucker rod guide which is a tubular integral body element formed of an elastic minimum friction type material and provided with a longitudinal bore formed along the longitudinal axis of the body, a transverse mounting slot opening from a side of the body into the bore dividing the body into opposite end portions, and a longitudinal mounting slot in each end portion extending radially inwardly into the bore and opening at one end through an end of the body and at the other end into the transverse slot, one of the longitudinal slots extending in the opposite radial directions from the other longitudinal slot, and each said slot being defined by radially outwardly diverging guide walls which also diverge toward the transverse mounting slot.

BRIEF DESCRIPTION OF THE DRAWING

The foregoing objects and advantages and a preferred embodiment of the invention will be understood from the following detailed description taken in conjunction with the accompanying drawings wherein.

DETAILED DESCRIPTION OF THE PREFERRED EMBODIMENT

Figure 1:
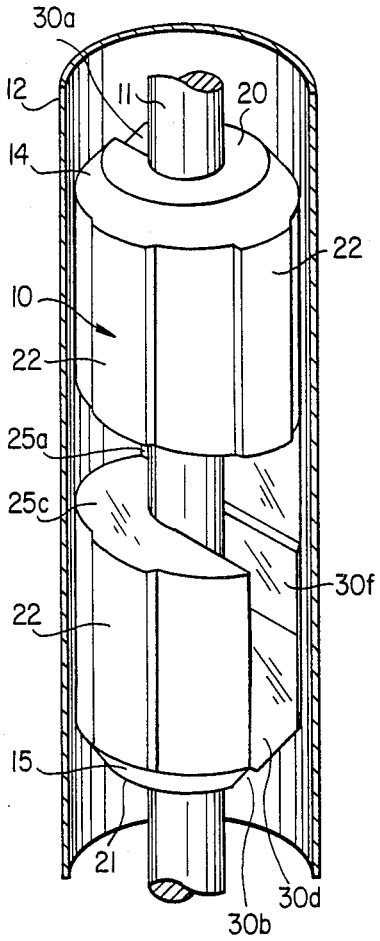
FIG. 1 is a perspective view partially in section showing a rod guide in accordance with the invention mounted on a sucker rod within a production tubing of a well.

Referring to FIG. 1, a sucker rod guide 10 embodying the features of the invention is designed for mounting on a sucker rod 11 operating within a well production tubing 12. While only a section of the production tubing and sucker rod are illustrated with a single sucker rod guide mounted on the rod, it will be understood that the production tubing and the sucker rod extends from a well head not shown, at the surface to a reciprocating pump not shown, at a producing depth in the tubing string. The sucker rod is generally a string made up of sections of sucker rod approximately 30 feet in length, and on the average from one to two of the sucker guides 10 are mounted on each of the sucker rod sections. The rod guides reciprocate with the sucker rod keeping the sucker rod in a central position within the tubing string as the sucker rod and guides reciprocate to produce well fluids through the tubing string. The well fluids flow around and through the slots in the rod guides as well fluids are lifted to the surface around the sucker rod in the production tubing wall.

Figure 2:
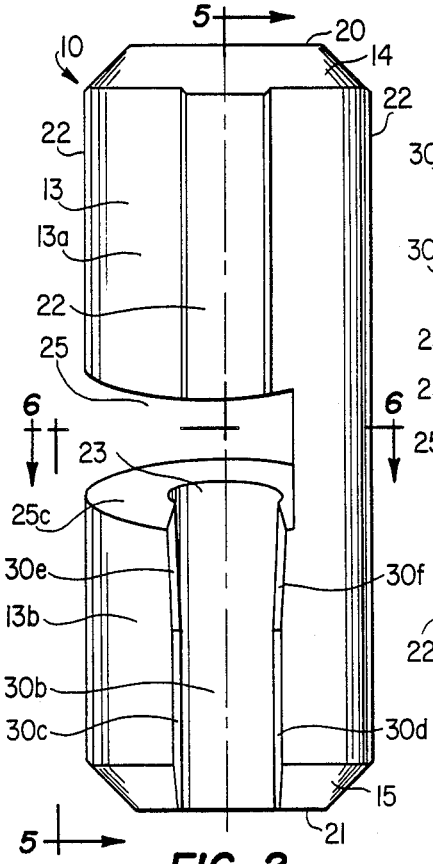
FIG. 2 is a side view in elevation of the rod guide of FIG. 1.

Referring to the drawings, the rod guide 10 is an integral cylindrical member formed of an elastic relatively hard material having low drag or friction characteristics such as nylon. The rod guide has a cylindrical outer wall surface 13 beveled at end surfaces 14 and 15. The beveled surface 14 slopes inwardly from the cylindrical surface 13 to a flat end edge 20. Similiarly, the beveled surface 15 slopes inwardly from the cylindrical surface 13 to an opposite end edge surface 21. The rod guide has a plurality of circumferentially spaced longitudinal ribs 22 extending the length of the guide between the beveled end surfaces 14 and 15. The ribs 22 provide a thickened body wall along lines of maximum stress as discussed hereinafter and also provide longitudinal bearing surfaces which engage the inner wall of the production tubing 12 as the rod guides and sucker rod reciprocate. The rod guide has a longitudinal bore 23 formed along an axis coincident with the longitudinal axis 24 of the rod guide body opening through opposite ends of the guide so that when the guide is installed on a sucker rod the rod is disposed through the bore of the guide as shown in FIG. 1. The rod guide body has a transverse mounting slot 25 which slopes relative to the longitudinal axis 24 of the guide extending across the guide body and inwardly as seen in FIG. 2 beyond and intersecting the bore 23. The transverse mounting slot effectively divides the rod guide body into first and second end portions 13*a* and 13*b*. The transverse mounting slot 25 is defined by a back wall surface 25*a* which lies in a plane parallel to and spaced from the longitudinal axis of the guide and parallel sloping, spaced, end surfaces 25*b* and 25*c*. The transverse mounting slot as defined by the space between the surfaces 25*b* and 25*c* is greater in width than the diameter of the sucker rod 11 for which the rod guide is designed.

Figure 3:
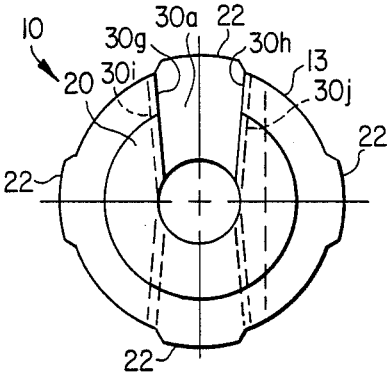
FIG. 3 is a top view of the rod guide as shown in FIG. 2.
Figure 5:
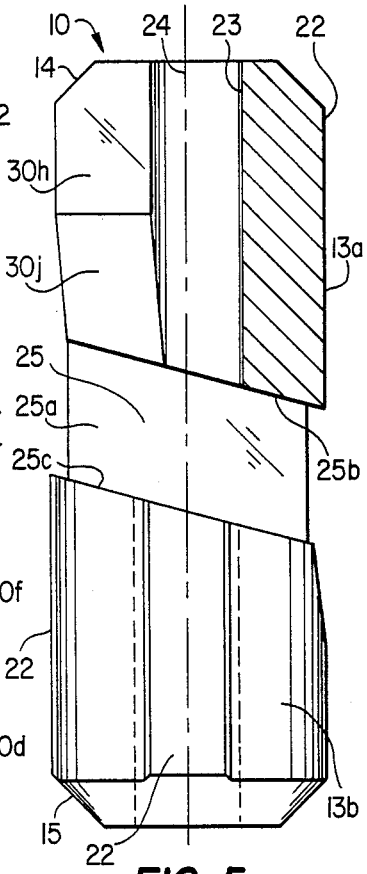
FIG. 5 is a longitudinal side view in elevation and section of the rod guide as seen along the line 5—5 of FIG. 2.
Figure 6:
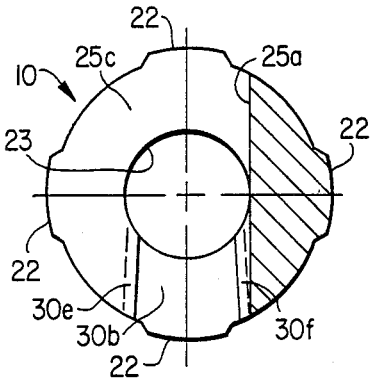
FIG. 6 is a view in section and elevation along the line 6—6 of FIG. 2.

The rod guide end portions 13*a* and 13*b* are each provided with a longitudinal mounting slot extending radially inwardly from the cylindrical outer wall surface of the guide body into the longitudinal bore 23 and extending lengthwise from an end edge surface of the guide into the transverse mounting slot 25. The longitudinal mounting slot in one of the end portions extends radially in one direction while the longitudinal mounting slot in the other end portion extends radially in the opposite direction. More specifically, the guide end portion 13*a* has a longitudinal mounting slot 30*a* which extends from and opens through the transverse slot surface 25*b* at one end and the end edge surface 20 at the opposite end. Similiarly, the rod guide end portion 13*b* is provided with the longitudinal mounting slot 30*b* which extends lengthwise from and opens through the transverse slot surface 25*c* and the end edge surface 21. Each of the longitudinal mounting slots extends inwardly radially opening into the longitudinal bore 23 of the rod guide. The longitudinal mounting slots are developed relative to a theoretical longitudinal plane through the rod guide body axis 24 parallel to the transverse mounting slot surface 25*a*. Each of the longitudinal mounting slots 30*a* and 30*b* is defined by opposite sidewall surfaces which converge inwardly toward the intersection of each longitudinal slot with the longitudinal bore of the guide. Stated otherwise, the sidewalls defining each of the longitudinal mounting slots are closer together at the bore through the rod guide than at the outer cylindrical surface of the guide. This is evident from the end views shown in FIGS. 3 and 4. Also, the longitudinal mounting slot sidewall converge from the transverse mounting slot toward each end of the guide body. The sidewalls defining each of the longitudinal mounting slots each comprises two wall surface portions lying in different planes. Referring to the lower portion 13*b* of the guide rod in FIG. 2, the longitudinal mounting slot 30*b* is defined by spaced sidewalls 30*c* and 30*d* and spaced sidewalls 30*e* and 30*f*. The sidewalls 30*c* and 30*e* are contiguous surfaces, while, similiarly, the sidewalls 30*d* and 30*f* are contiguous surfaces. The sidewalls 30*c* and 30*d* slope together radially approaching the bore 23 of the rod guide and lie in longitudinal planes oriented with respect to each other equidistant from each other so that lines drawn in the surfaces 30*c* and 30*d* parallel to the longitudinal axis 24 are parallel to each other. The longitudinal slot sidewall surfaces 30*e* and 30*f*, however, slope together toward the intersection of the slot with the bore 23 and also slope together toward the end surface 21 of the rod guide. As evident in FIG. 2 the surfaces 30*e* and 30*f* are farther apart at the intersection of the slot 30*b* with the transverse slot surface 25*c* than the surfaces 30*e* and 30*f* are spaced at the juncture between the such surfaces and the sidewall surfaces 30*c* and 30*d*. If a theoretical plane were provided perpendicular to the transverse backwall surface 25*a*, parallel with the longitudinal axis 24 of the guide body, and through the sidewall surfaces 30*e* and 30*f*, the lines of intersection between such theoretical plane and the surfaces 30*e* and 30*f* would slope toward each other from the surfaces 25*c* toward the end surface 21. The degree of slope of each of the surfaces 30*e* and 30*f* relative to the longitudinal axis 24 is approximately 2½ degrees for one range of sizes of the rod guide made. Similiarly, the radial degree of slope of surfaces 30*c* and 30*d* relative to a center plane between the surfaces through the longitudinal axis 24 is also 2½ degrees. The dimensioning of the longitudinal mounting slot 30*b* as well as the bore 23 provides a tight fit of the rod guide on the rod 11. For easy entry of the rod 11 into the mounting slot, the dimension A which is the maximum width of the slot at the intersection of the surfaces 30*e* and 30*f* with the outer cylindrical surface of the guide at the transverse slot surface 25*c* is substantially equal to the diameter of the rod on which the guide is mounted. The slot longitudinal slot dimensions C and D at the intersection of the slot with the bore 23 as well as the diameter of the bore are all less than the diameter of the sucker rod 11 so that when the rod guide is installed on the rod the material forming the guide is under stress causing the guide to tightly grip the rod. The longitudinal mounting slot 30*a* in the other end portion 13*a* of the rod guide is defined by an identical set of sidewall guide surfaces. Referring to FIGS. 3 and 5, the longitudinal mounting slot 30*a* is defined by spaced sloping sidewalls 30*g* and 30*h* and 30*i* and 30*j*. The juncture between the contiguous side surfaces 30*h* and 30*j* as well as the intersection of the surface 30*j* with the transverse mounting slot surface 25*b* are best seen in FIG. 5. Of course, it is recognized that the longitudinal slot 30*a* opens radially in the opposite direction from the longitudinal mounting slot 30*b*. The orientation of the longitudinal mounting slot 30*a* and 30*b* as well as the transverse slot 25 relative to the longitudinal bore 23 positions the transverse slot back surface 25*a* in a plane parallel to and spaced from the longitudinal axis 24 of the guide. The surface 25*a* may be spaced into the guide body a short distance from the sidewall of the bore 23 nearest the surface 25*a* as well as from the line of intersection of the surface 30*f* with the surface 25*c*. This provides more room for maneuvering the guide onto the rod 11. The longitudinal mounting slot 30*a* and 30*b* are widest at the intersections of the slot side surfaces with the cylindrical outer surface of the guide at the transverse slot 25 at which point each of the longitudinal slots is approximately the same width as the rod 11 on which the guide is to be mounted.

It will be noted that there is a longitudinal rib 22 extending along the guide body opposite or 180 degrees around the guide from each of the longitudinal mounting slots 30*a* and 30*b* to provide maximum wall thickness along longitudinal hinge lines not shown, in the material about which guide body side portion on opposite sides of the slots pivot when the rod guide is forced onto the rod 11 in mounting the guide spreading the guide body end portion.

Figure 4:
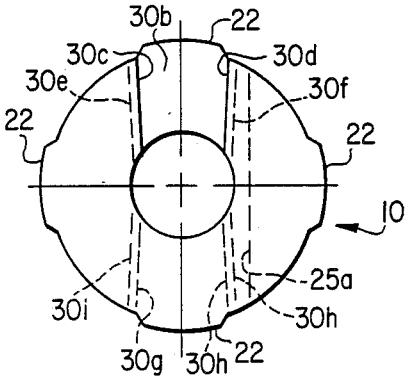
FIG. 4 is a bottom view of the rod guide as seen in FIG.

The sucker rod guide 10 is installed at the desired location along a sucker rod section 11 by holding the guide next to the rod, aligning the slot 25 with the longitudinal axis of the rod, and then moving the guide laterally toward the rod until the rod is fully disposed through the slot 25. The longitudinal axis of the guide will, of course, be at substantial angle with the longitudinal axis of the rod when the rod and the slot 25 are in alignment so that the guide will easily fit on the rod. Such positioning of a guide relative to a rod is clearly shown in FIG. IX of U.S. Pat. No. 3,186, 773. The guide 10 may be installed using a wrench such as the wrench 70 illustrated in FIG. 11 of U.S. Pat. No. 3,650,579. Such a wrench will hold the guide as well as provide substantial leverage for accomplishing the final installation steps. With the guide at the angular position and the rod disposed through the slot 25, the guide is then rotated about an axis perpendicular to the longitudinal axis 24 of the guide extending through the center line of the slot 25. This rotation step also illustrated in the reference patents at FIG. IX of U.S. Pat. No. 3,186,773 and FIG. 11 of U.S. Pat. No. 3,650,579. Viewing the guide 10 as shown on the rod in FIG. 1 such rotation would be in a counterclockwise direction as illustrated to the reader. As the guide is rotated from the angular position at which the rod 11 is aligned through the slot 25, the sections of the rod 11 as seen in FIG. 1 above the slot 25 and below the slot 25 enter the guide slots 30*a* and 30*b*, respectively. The guide surfaces defining the sidewall of the longitudinal mounting slots cause the rod to be received in the longitudinal slots directing the rod guide 10 to the final installed position shown in FIG. 1. Because the dimension A at the widest part of each of the longitudinal mounting slots is approximately the same diameter as the rod 11, the portions of the rod along the longitudinal slots surfaces 30*e* and 30*f* of the lower slot 30*b* and the surfaces 30*i* and 30*j* of the upper slot 30*a* cause the rod to pass into each of the longitudinal slots as the rod guide is rotated until the rod is fully disposed through the bore 23 at which time the guide is installed in the correct position on the rod. As the rod sections move into the longitudinal mounting slots, and because the inwardly converging slots approach widths which are narrower than the rod diameter, the nylon material of the rod guide is stressed deforming the guide spreading the portions of the guide on either side of each of the longitudinal mounting slots until the guide snaps fully into place on the rod. This deformation causes the portions of the guide on opposite sides of each of the longitudinal mounting slots to effectively pivot about a theoretical hinge line, not shown, as previously mentioned, which is a longitudinal line parallel with the axis 24 extending along the length of the upper and lower sections of the guide in the thickened parts of the guide along the rib 22 opposite of each of the longitudinal slots. For example as shown in FIG. 4 this hinge line would be a vertical axis in the portion of the guide along the bottom rib 22 as shown in FIG. 4 opposite the longitudinal slot 30*b*. Because the material is thicker along the rib 22 there is less tendency to cause fatigue damage in the guide when it is installed. Also, because of the increased thickeness of the guide material along the rib the holding power is increased causing the guide to more tightly grip the rod 11. The diameter of the bore 23 is somewhat less than the diameter of the rod and thus the guide remains under stress when fully installed to hold tightly on the rod. During the installation procedure, however, the fact that the longitudinal slots converge inwardly toward the centerline of the rod guide, the moment arm applied to stress the material of the guide is not as great as in the prior art devices in which the longitudinal installation slots diverge toward the centerline of the guide.

Generally, sucker rod guides 10 are installed on each of the sections of a sucker rod 11 making up a sucker rod string in a well. One or two or more of the rod guides may be installed on each section of sucker rod, which as previously indicated are approximately 30 feet long. With the rod guides on the sucker rod, the sucker rod string is maintained at a central position along the tubing 12 as the rod and the guides reciprocate to operate a well pump. Deviations in the direction of the production tubing string will cause some of the rod guides to drag along the inner wall of the tubing string. Along the portion of the tubing string where the rod guides drag, the guides engage the inner wall of the tubing along the longitudinal ribs 22 which provide less opposing friction than in the prior art rod guides which are cylindrical in shape without ribs so that a larger surface area of the rod guide will drag along the tubing wall. Additionally, the increased thickness provided by the ribs increases the wear life of the guides of the present invention. The upwardly flowing pumped well fluids pass around the rod guides between the rod guide outer surfaces and the inner wall surface of the tubing. The outwardly diverging longitudinal mounting slots 30*a* and 30*b* with the transverse slot 25 provide maximum flow area for the well fluids as the fluids pass each of the rod guides. The sizing between the longitudinal mounting slots, the longitudinal bore 23, and the sucker rod provides sufficient stress in the rod guide to tightly hold the rod guide on the rod. The fact that the bore portions through the rod guide along the opposite end portions of the guide are formed along the same common longitudinal axis of the guide holds each guide in exact alignment with the longitudinal axis of the sucker rod in contrast with prior art devices having misaligned bores so that each of the guides is somewhat crooked on the rod causing uneven wear on the guide and somewhat less effective centralizing of the sucker rod string.

It will now be seen that a new and improved rod guide for well sucker rods has been described and illustrated. The guide includes a greater material mass along the lines of greater stress thus providing a longer life and increased holding power than similiar prior art devices. The mounting slot configuration as well as the longitudinal ribs provide features which decrease the frictional contact between the rod guides and the tubing wall as well as improving fluid flow in the tubing along the rod guides.

What is claimed is:

1. A well pump sucker rod guide comprising:

a substantially cylindrical elastic body having a longitudinal bore along an axis conincident with the longitudinal axis of said body;

said body having a transverse mounting slot extending from a side of said body into said body intersecting said bore and dividing said body into opposite end portions;

said body having two longitudinal mounting slots;

each of said end portions of said body having one of said longitudinal mounting slots opening through a side of said body into said longitudinal bore and opening at one end into said transverse mounting slot and at the other end thereof through the adjacent end of said body;

said longitudinal mounting slots being aligned radially in the same directions as said transverse slot;

one of said longitudinal mounting slots opening through one side of said body and the other of said longitudinal mounting slots opening through the opposite side of said body;

each of said mounting slots being defined by side guide surface walls sloping radially in converging relation toward said longitudinal bore and sloping longitudinally in converging relation away from said transverse mounting slot and toward the end of said body through which each of said respective longitudinal mounting slots open.

2. A sucker rod guide in accordance with claim 1 wherein each of said longitudinal mounting slots has a maximum width at the outer surface of said body at said transverses slot substantially equal to the diameter of a sucker rod on which said rod guide is used.

3. A sucker rod guide in accordance with claim 2 wherein each of said longitudinal mounting slots at said bore is narrower than said sucker rod.

4. A sucker rod guide in accordance with claim 3 wherein said side guide wall surfaces of each of said longitudinal mounting slots comprises at least two contiguous surface portions, the mounting surface portions nearest the adjacent end of said body extending longitudinally in equidistant relation and the guide surfaces defining the portion of said longitudinal mounting slot opening to said transverse slot extending in diverging relation toward said transverse slot.

5. A sucker rod guide in accordance with claim 4 wherein said transverse slot extends at an angle with said longitudinal axis of said body.

6. A sucker rod guide in accordance with claim 5 wherein said transverse mounting slot is defined by a back wall surface lying in a plane parallel with and spaced from said longitudinal axis of said body and opposite end walls lying in spaced parallel planes.

7. A sucker rod guide in accordance with claim 6 wherein said longitudinal mounting slots are developed in relation to a plane extending through said longitudinal axis of said body parallel with said back wall of said transverse mounting slot.

8. A sucker rod guide in accordance with claim 7 wherein said longitudinal guide wall surfaces adjacent each end of said body extend radially in diverging relationship from said bore toward the outer side wall surface of said body and said guide side wall surfaces of said longitudinal mounting slots adjacent to said transverse mounting slots extend in diverging relationship both radially and longitudinally from said bore toward the outer wall surface of said body and toward said transverse mounting slot.

9. A sucker rod guide in accordance with claim 1 including a plurality of longitudinal circumferentially spaced ribs along said body providing a thickened wall surface along said body opposite each of said longitudinal mounting slots.

10. A sucker rod guide in accordance with claim 2 including a plurality of longitudinal circumferentially spaced ribs along said body providing a thickened wall surface along said body opposite each of said longitudinal mounting slots.

11. A sucker rod guide in accordance with claim 3 including a plurality of longitudinal circumferentially spaced ribs along said body providing a thickened will surface along said body opposite each of said longitudinal mounting slots.

12. A sucker rod guide in accordance with claim 4 including a plurality of longitudinal circumferentially spaced ribs along said body providing a thickened wall surface along said body opposite each of said longitudinal mounting slots.

13. A sucker rod guide in accordance with claim 5 including a plurality of longitudinal circumferentially spaced ribs along said body providing a thickened wall surface along said body opposite each of said longitudinal mounting slots.

14. A sucker rod guide in accordance with claim 6 including a plurality of longitudinal circumferentially spaced ribs along said body providing a thickened wall surface along said body opposite each of said longitudinal mounting slots.

15. A sucker rod guide in accordance with claim 7 including a plurality of longitudinal circumferentially spaced ribs along said body providing a thickened wall surface along said body opposite each of said longitudinal mounting slots.

16. A sucker rod guide in accordance with claim 8 including a plurality of longitudinal circumferentially spaced ribs along said body providing a thickened wall surface along said body opposite each of said longitudinal mounting slots.

17. A guide for a well pump sucker rod comprising:

a substantially cylindrical elastic body having a longitudinal bore extending along an axis coincident with the axis of said body;

said body having opposite end outer edge surfaces tapered from the outer surface of said body convergently inwardly toward the end edge of said body;

said body having a transverse mounting slot dividing said body into substantially equal opposite end portions, said mounting slot extending from a side of said body transversly across said body intersecting the entire cross section of said longitudinal bore and defined by an inside backwall surface lying in a plane parallel with and spaced from said longitudinal axis of said body and opposite end walls lying in spaced apart parallel planes extending at an angle to said longitudinal axis of said body;

said body having a longitudinal mounting slot in each of said opppsite end portions, each of said mounting slots opening from an outer sidewall of said body and extending radially inwardly into said longitudinal bore of said body an opening at one end into said transverse mounting slot and at the opposite end through the end edge of said body, each of said longitudinal mounting slots being defined by spaced apart side guide wall surfaces comprising at least two surface portions lying in different planes, the sidewall surfaces defining the portion of said longitudinal slot opening through the end of said body extending from said bore to the outer surface of said body in equidistant diverging relation and the sidewall surface defining the portion of said longitudinal mounting slot opening into said transverse mounting slot extending in diverging relation from said bore to said outer wall surface of said body and extending diverging relation toward said transverse mounting slot;

said longitudinal mounting slots having a widest portion at said transverse mounting slot at said outer surface of said body of a dimension substantially equal to the diameter of a sucker rod on which said guide is mounted; and said body being provided with a plurality of external longitudinal circumferentially spaced ribs providing a thickened wall portion along the external surface portions of said body opposite each of said longitudinal mounting slots and between said longitudinal mounting slots.

* * * * *